United States Patent [19]

Fiergolla et al.

[11] 4,416,099

[45] Nov. 22, 1983

[54] COMPOUND GIRDER FORMING A RIGID CONNECTION FOR PREFABRICATED CEILING PANELS

[76] Inventors: Ulrich Fiergolla, Schillerstrasse 8, 4992 Espelkamp; Josef Rottmayr, Eduard-Schmid-Strasse 26, 8000 Muenchen 90, both of Fed. Rep. of Germany

[21] Appl. No.: 264,416

[22] Filed: May 18, 1981

[30] Foreign Application Priority Data

May 23, 1980 [DE] Fed. Rep. of Germany ..... 3019744

[51] Int. Cl.[3] ..... E04B 1/20

[52] U.S. Cl. ..... 52/319; 52/334; 52/729

[58] Field of Search ..... 52/602, 334, 319, 693, 52/692, 729, 732, 326, 341

[56] References Cited

U.S. PATENT DOCUMENTS

| | | | |
|---|---|---|---|
| 1,906,683 | 5/1933 | Weiskopf et al. | 52/729 |
| 1,979,643 | 11/1934 | Sahlberg | 52/334 |
| 3,093,932 | 6/1963 | Drier et al. | 52/319 X |
| 3,263,387 | 8/1966 | Simpson | 52/729 X |
| 3,385,015 | 5/1968 | Hadley | 52/732 X |
| 4,115,971 | 9/1978 | Varga | 52/334 |

FOREIGN PATENT DOCUMENTS

| | | | |
|---|---|---|---|
| 1138531 | 10/1962 | Fed. Rep. of Germany | 52/692 |

*Primary Examiner*—Kenneth Downey

*Attorney, Agent, or Firm*—W. G. Fasse; D. H. Kane, Jr.

[57] ABSTRACT

A compound girder of an on-site assembly type is assembled to include components which rigidly interconnect two or more prefabricated ceiling panels (3*a*, 3*b*) in a bending stiff manner. The compound girder includes for each ceiling panel (3*a*, 3*b*) at least one web section (1*a*, 1*b*) and an upper chord section (2*a*, 2*b*). The girder further includes a continuous length lower chord (4). The lower chord (4) takes up the tension and shearing loads. The individual web sections (1*a*, 1*b*) are secured to the lower chord (4) by screw connections which prevent a sliding displacement between the connected elements relative to each other.

9 Claims, 4 Drawing Figures

COMPOUND GIRDER FORMING A RIGID CONNECTION FOR PREFABRICATED CEILING PANELS

CROSS-REFERENCE TO RELATED APPLICATIONS

The present application corresponds to German Ser. No. P 3,019,744.5, filed in the Federal Republic of Germany on May 23, 1980. The priority of the German filing date is hereby claimed.

BACKGROUND OF THE INVENTION

The present invention relates to a compound girder forming a rigid connection for prefabricated ceiling panels. The present invention also relates to a method of manufacturing such girders. Such girders interconnect the ceiling panels in a bending stiff manner upon assembly at the building site.

Heretofore it was customary to assemble compound structures at the building site rather than to use predominantly preassembled components made in a factory. The methods assemblying the steel construction at the building site involve embedding the upper portions or rather the upper chord of a compound girder in the concrete as it is being poured at the building site. Several different types of steel structures are known for use in this kind of building construction.

German Pat. No. 76,977 discloses web plates which extend at a right angle out of a concrete panel, the free ends of the web plates extending out of the concrete panel are equipped with angle or sectional steel forming a chord, whereby the web plates may be subdivided by gaps providing a protection against thermal stresses.

U.S. Pat. No. 1,047,030 discloses a structure in which two L-sectional steel beams form a lower chord. Diagonal rods are secured between the L-sectional beams by means of screws. The upper ends of these diagonal rods are embedded in the concrete. The space between the lower chord and the concrete is filled by masonry.

It is also known that the steel structure of truss frameworks may comprise L-sectional steel lower chords, see for example U.S. Pat. Nos. 1,979,643 and 4,056,908, as well as German Patent Publication No. 2,123,351. U.S. Pat. No. 4,115,971 discloses structures with so-called honeycomb girders.

Contrary to the above prior art it is presently predominantly customary to prefabricate compound structural components. In this type of structure the individual ceiling panels are prefabricated in the factory or in the shop in sizes suitable for transportation. These panels are then assembled at the construction site to form, for example, a ceiling or a bridge. The individual ceiling panels may be steel reinforced concrete panels or they may be of the compound structure type or they may comprise compound structures including steel constructions extending in the direction of one axis only, whereby the assembly of the compound structure takes place at the building site, see for example German Publication No. 2,153,495 and U.S. Pat. No. 2,000,110.

In order to assemble such individual ceiling panels into a continuous ceiling it is customary to support the ceiling panels by means of so-called sleeper girders. It is possible to construct such sleeper girders together with the ceiling panels as a compound girder. It is the purpose of such a compound girder to interconnect two or more ceiling panels with each other in such a manner that a load bearing effect is achieved in a direction across the longitudinal extension of the joints between adjacent ceiling panels, whereby the ceiling panels themselves form a chord of the compound girder.

Compound girders including premanufactured ceiling panels are also known, for example, in connection with bridge construction. In this type of structure prefabricated ceiling or cover panels are secured to an I-beam in a manner secure against relative sliding between the panel and the I-beam by means of screws. This type of connection is described in more detail as an HV-connection in the German Industrial Standards DIN 1050. The gaps between adjacent panels are filled at the building site with a concrete mix. According to yet another prior art structure the sliding preventing screw connection is replaced by headed bolt dowels or by tholes welded in such a manner to the upper chord of the I-beam that these tholes or bolt heads reach into recesses of the cover panels. The recesses are then filled with concrete mix at the construction site. When the concrete in the joints between adjacent panels or in the recesses has hardened, one obtains a compound girder which provides a bending stiff connection of the prefabricated ceiling or cover panels. German Patent Publication No. 1,534,703 relating to a ceiling structure employing a compound girder construction method is based on this type of compound girders.

It is further known from German Patent Publication No. 2,526,278 also relating to a ceiling structure employing a compound girder method of construction, to provide the edges extending in the girder direction of ceiling panels, with angle steel and to weld headed bolts to the angle steel sections. These sections are screwed to an uninterrupted I-beam in a manner preventing any sliding between the sections and the I-beam.

Compound girders as described above have certain disadvantages. It is a common feature of all these girders that the connection, which is supposed to take up shearing loads between the chords is accomplished by connecting means such as a screw connection or a thole pin connection for preventing a relative sliding movement. Such a connection provides but one shearing plane in which the shearing loads are effective. Such single plane shear connections involve a high expenditure because a substantial number of connecting elements are required and must be installed.

It is further a basic disadvantage that the upper chord is weakened due to individual recesses which are filled with concrete at the construction site, such concrete having a lower strength characteristic. Similarly, it is disadvantageous if the upper chord cross-sectional area is diminished due to the space requirement for the screw connection components whereby the upper chord is weakened. This fact is especially disadvantageous for girders arranged along edges because the distribution of the forces effective on the upper chord into the ceiling panel exposes the compound girder to twisting due to torsion loads. Another disadvantage is seen in that in all of the mentioned structures the upper flange or chord of the I-beam is arranged below or under the ceiling panel which is disadvantageous in a static sense and its static load capacity is hence hardly utilized. Yet another specific disadvantage of the just mentioned compound girder is seen in the fact that an interruption of the bending stiffness of the ceiling panel in a direction extending perpendicularly to the compound girder axis cannot be avoided. Thus, it is, for example, not at all possible to use this type of ceiling panel in a cantilevered construction unless additional structural features are employed.

OBJECTS OF THE INVENTION

In view of the above it is the aim of the invention to achieve the followng objects singly or in combination:

- to provide a compound girder of the on-site assembly type which will interconnect prefabricated ceiling panels in a bending stiff manner;
- to provide a method for the construction of such a compound girder;
- to construct a compound girder which will provide the required shearing connection between the chords of the girder at low costs, while simultaneously assuring a statically more efficient utilization of the girder material;
- to construct a compound girder which will maintain the bending stiffness of the ceiling panels in a direction extending substantially perpendicularly to the longitudinal extension of the compound girder; and
- to interconnect the web sections of the girder with the lower chord in a force transmitting manner, whereby sliding movements between the web sections and the lower chord of the compound girder are prevented and whereby large tolerance screw holes may be employed in an economical manner.

SUMMARY OF THE INVENTION

According to the invention there is provided a compound girder of the on-site assembly type which provides a bending stiff connection of prefabricated ceiling panels and including an upper chord which is connected with the individual ceiling panels as well as webs and an uninterrupted lower chord. The upper chord and the web is divided into sections whereby the length of these sections corresponds substantially to the given width of the respective ceiling panel. The upper chord sections and an adjacent portion of the respective web section are embedded in the ceiling panel when the latter is prefabricated. An uninterrupted lower chord is connected or secured to the lower web portions of each section extending downwardly out of the respective ceiling panel.

The advantages achieved by the invention are seen primarily in the fact that the connecting means for transmitting shearing loads may be dimensioned several times smaller than prior art corresponding respective means while simultaneously providing the same strength as prior art connections although being substantially smaller in size. Further, the upper chord in the girder according to the invention does not require any weakening cut-outs or recesses. The cross-sectionally effective portions, especially of the upper chord, are located in a statically most advantageous position. The bending stiffness of the ceiling panels according to the invention in the direction across to the longitudinal axis of the girder is available without any interruptions throughout the structure.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
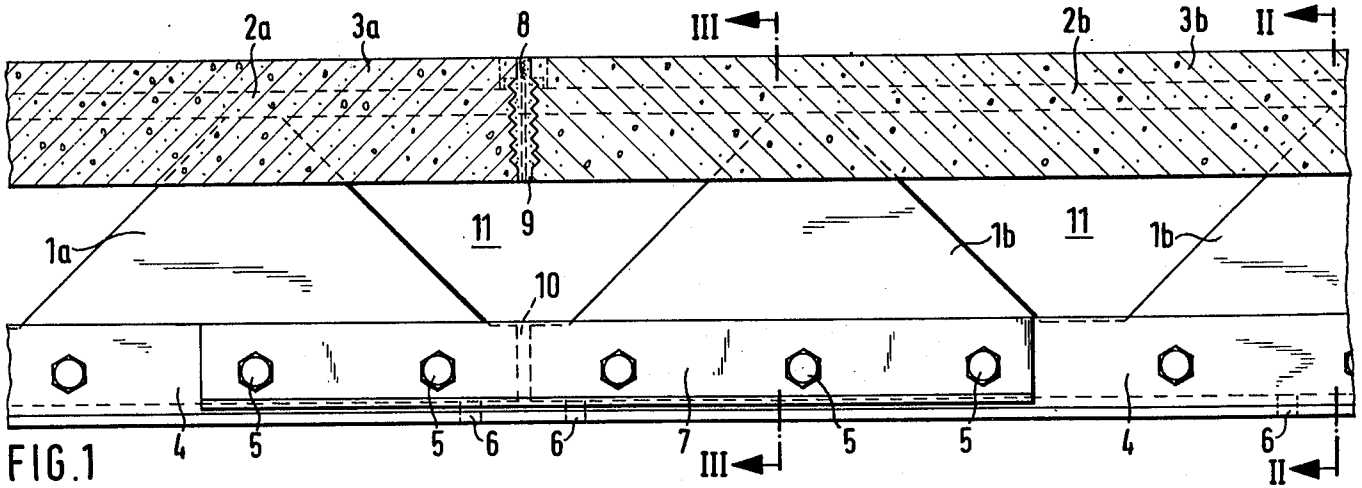
FIG. 1 is a side view of an assembled compound girder according to the invention with two adjoining ceiling panels shown in section.
Figure 3:
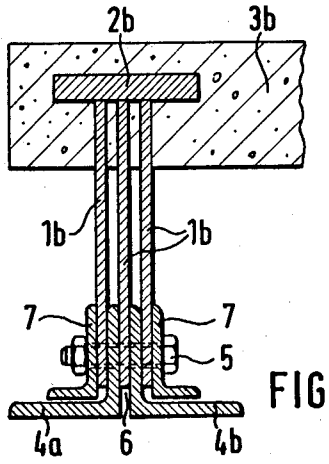
FIG. 3 is a sectional view along section line 3—3 in FIG. 1.
Figure 2:
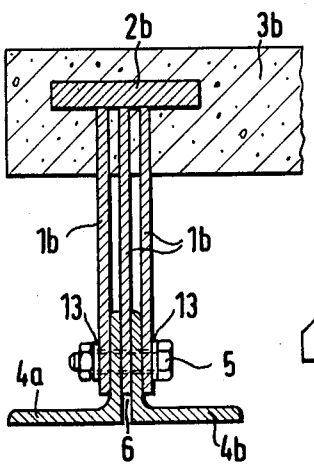
FIG. 2 is a sectional view along section line 2—2 in FIG. 1.

FIG. 1 shows substantially the assembly or connection of a comound girder according to the invention comprising web sections 1*a* and 1*b* located adjacent to a joint between two ceiling panels 3*a* and 3*b*. The web sections 1*a*, 1*b* are made of flat steel having a sufficient width and cut into two portions substantially along a zig-zag line. The girder further comprises two upper chord sections or members 2*a* and 2*b* embedded in the concrete of the ceiling panels 3*a*, 3*b*. The girder further comprises an uninterrupted, continuous lower chord 4 in the form of two angle sections 4*a*, 4*b* as best seen in FIGS. 2 and 3. However, the invention is not limited to using for the lower chord angle steel sections as shown.

Figure 4:
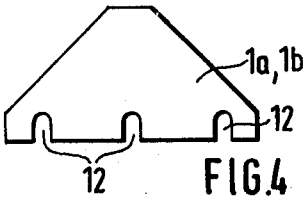
FIG. 4 is a side view of a web section for a girder according to the invention.

Each web section 1*a*, 1*b* comprises three web plates, again as best seen in FIGS. 2 and 3, having a substantially triangular side shape as shown in FIG. 4 with the corners of the triangle cut-off, if desired. These plates are formed, as mentioned, by cutting a flat steel strip of sufficient width along a zig-zag line into two positions, whereby the individual triangle shapes may be interconnected, if desired, at the corners adjacent to the hypotenuse. The upper corner of the web plates 1*a*, 1*b* is welded to the upper chord sections 2*a*, 2*b*. This welding is accomplished in the shop or factory and the so prepared sections are then embedded in the ceiling panels when the concrete of these panels is being poured during the prefabrication in the factory. The upper chord sections 2*a*, 2*b* are embedded approximately in the upper half portion of the respective ceiling panels 3*a*, 3*b* and the downwardly extending portions of the web plates 1*a*, 1*b* protrude downwardly from the panel.

During the on-site assembly the ends of the continuous length lower chord 4 are first secured to supports such as walls or posts. Additionally, the middle portion of the lower chord is temporarily supported by an assembly post to slightly raise the center portion of the chord above the level which it will assume after completion of the assembly. The lower chord members 4*a* and 4*b* are so positioned that the web plates 1*a*, 1*b* are placed into contact with the upwardly reaching legs of the lower chord members 4*a*, 4*b* as best seen in FIGS. 2 and 3. Thus, the lower edges of the web plate are contacting the respective leg surfaces of the lower chord members while the upper end of the web plates are already embedded in the ceiling panels as a result of the preassembly described above. The web plates and the upwardly reaching legs of the lower chord members 4*a*, 4*b* are then interconnected by a screw connection 5, whereby it is preferable to use a so-called HV-screw connection which is characterized by a tight clamping of the interconnected members so as to prevent a relative sliding between the interconnected members. The connection may be accomplished either by holes in the web plates or by downwardly opened apertures 12 in the web plates as shown in FIG. 4. So-called HV-screw connections have the advantage that the downwardly opened apertures or even respective holes may have substantial tolerances which facilitate the assembly.

Any tolerances in a direction perpendicularly to the plane of the compound girder are compensated by forcing the relatively flexible web plates 1*a*, 1*b* into the axial direction of the lower chord 4. In order to facilitate the insertion of the web plates into a position as shown in FIG. 2 or 3, it is possible to spread the two outer web plates of a set of three web plates laterally apart away from the central web plate and to additionally keep the legs of the lower chord members properly spaced by means of a spacer 6.

The individual sets of web plates are spaced in the axial direction so as to leave free channels 11 between adjacent web plates. These spaces 11 may be utilized for installing plumbing system components, electrical cables, and so forth.

The downwardly open apertures 12 have the additional advantage, that the screw bolts and nuts 5 may be preassembled in the upwardly pointing legs of the lower chord 4 with the necessary play.

Where it is necessary to provide a butt joint as shown at 10 in FIG. 1, additional sectional members 7 may be connected to the lower chord 4 by means of the same screw connection 5 as shown in FIG. 3. These additional sectional members transmit any shearing load across the butt joint 10. The transmission of pressure forces or loads across the joint between the ceiling panel 3*a* and the ceiling panel 3*b* is accomplished by inserting a reinforcing steel member 8 into the joint and filling the joint with poured-in concrete 9.

Modifications of the illustrated construction are within the scope of the appended claims. For example, instead of using a lower chord comprising two angle sectional steel members 4*a* and 4*b* it is possible to use a single T-section steel beam. In that embodiment a set of web plates would comprise two web plates which receive the upwardly pointing leg of the T-section therebetween. Further, it is not necessary that the web plates are spaced from one another as shown in FIGS. 2 and 3. It is possible that the web plates contact each other in which case they would all be received between the upwardly pointing legs of, for example, two angle sections 4*a*, 4*b*. The spacer 6 would be made wider in such an embodiment to accommodate the width of the web plates.

As mentioned above, the separation of the web sections into a number of plates has the advantage that during the onsite assembly any manufacturing tolerances in a direction perpendicularly to the length of the compound girder are easily compensated because the relatively elastic web plates may be bent slightly for alignment with the longitudinal extension of the lower chord. Due to the rigid interconnection of the web plates relative to each other at the lower chord it has been found that the total strength or stability of such a web is only slightly smaller than the strength or stability of a web section not divided into several web plates.

The above mentioned spaces 11 for the installation of plumbing and other utility components is easily accomplished in that the web plates are cut as one half of a relatively flat steel strip having the width necessary for severing this strip along a zig-zag line. Another advantage of the spaces 11 is seen in that during the prefabrication the reinforcement steel bars for the lower portion of the ceiling panel may be inserted through these openings 11 in a direction extending substantially perpendicularly to the plane defined by the longitudinal axis of the compound girder.

The nuts and bolt connections 5 have been found to be quite suitable for transmitting the forces from the web sections 1*a*, 1*b* into the lower chord and vice versa. If desired, washers 13 may be used as shown in FIG. 2. Although form-locking connections for the nuts and bolts 5 may be preferable from a strength point of view, it has been found that substantially the same strength characteristics may be obtained with the above described force-locking connections which can be accomplished with large tolerance holes or slots 12 rather than with holes into which the bolts fit in a form-locking manner. The clamping action of the nuts and bolts connection 5 has been found to be quite satisfactory if the forces transmitted through such large tolerance nuts and bolts connection provide a sufficient frictional load so that sliding movements between the web plates and the legs of the lower chord are prevented. Screw bolts and nuts of high tension steel are used for this purpose to permit for a large tightening moment to thereby transmit the clamping forces which are necessary for the above mentioned load transmission from the web plates to the lower chord and vice versa. In any event, a multiple shearing connection is provided between the bolts and the web plates as well as the chord members. In this connection it should be emphasized that the large tolerance, downwardly open slots 12 greatly facilitate the preassembly because the precise fitting of the bolts into precisely drilled holes is avoided. This facility is particularly effective with regard to the vertical position of the screw bolts and nuts. Another advantage results from the downwardly open slots 12 because they make it possible to preassemble the nuts and bolts in the lower chord members even before the assembly of the ceiling panels.

Although the invention has been described with reference to specific example embodiments, it will be appreciated, that is is intended, to cover all modifications and equivalents within the scope of the appended claims.

What is claimed is:

1. A compound girder of a type to be assembled at least partially at the building site, for rigidly connecting in a bending stiff manner a plurality of prefabricated concrete ceiling panels each panel having a given width, comprising separate compression upper chord sections each corresponding in its length substantially to the given width of the corresponding concrete ceiling panel, said separate upper chord sections being embedded in the concrete of the respective ceiling panel, a plurality of initially separate web means rigidly and individually secured to the respective separate upper chord section, said separate web means having an upper portion partially embedded in the concrete of the respective ceiling panel so that a lower portion of the separate web means projects from the respective ceiling panel, initially separate lower tension chord means having an uninterrupted length corresponding to the girder length, and connecting means securing said projecting lower web portions to said lower chord means, whereby the length of the ceiling panels extends across the length of the girder.

2. The girder of claim 1, wherein said initially separate web means comprise web sections corresponding in number to the plurality of ceiling panels, each web section comprising several web plates arranged in parallel to each other.

3. The girder of claim 1 or 2, wherein said initially separate web means or said web plates comprise one half of a steel plate of sufficient width which has been severed substantially along a zig-zag line.

4. The girder of claim 1 or 2, wherein said connecting means secure said web means to said lower chord means in a rigid, force transmitting manner.

5. The girder of claim 4, wherein said connecting means comprise threaded bolt and nut means which clamp said lower chord means and said web means together in a manner preventing any sliding between the lower chord means and said web means.

6. The girder of claim 5, wherein said web means comprise laterally open slot means through which said threaded bolt means extend, whereby the nut and bolt means may be preassembled in holes of said lower chord means.

7. A method for assembling a plurality of ceiling panels to form a ceiling, each ceiling panel having a given width comprising the following steps: providing upper chord steel girder sections each substantially corresponding in its length to the given panel width and a plurality of initially separate flat steel web sections of substantially triangular shape, said girder sections and said web sections comprising at least one upper compression chord section and one web section for each ceiling panel, prefabricating the ceiling panels by welding a corner portion of each web section to its upper chord section, preparing and pouring concrete mix into molds to form said ceiling panels, substantially simultaneously with said pouring embedding an upper chord section and a corner portion of the respective web section in the concrete so that the web section substantially protrudes with a side portion from its respective ceiling panel, and securing at the construction site a separate lower tension chord section of continuous length to said protruding side portions, whereby the length of the ceiling panels extends across the length of the girder.

8. The method of claim 7, comprising welding said corner portions of the web sections to the respective upper chord section prior to embedding the upper chord sections in the respective ceiling panel and welding, at the building site, the continuous length lower chord section to the protruding side portions of the web sections.

9. The method of claim 7, comprising providing said protruding side portions of said web sections with apertures which are open toward the edge of the respective web section, providing said lower chord section with holes, preassembling bolts and nuts in said holes of the lower chord section, inserting the bolts into said apertures and tightening said nuts for securing the lower chord section to the web sections in a force locking manner.

* * * * *